United States Patent [19]

Davidson et al.

[11] Patent Number: 4,730,417

[45] Date of Patent: Mar. 15, 1988

[54] FINISHING METHOD AND APPARATUS

[75] Inventors: Richard L. Davidson; Richard S. Davidson, both of Sturgis, Mich.

[73] Assignee: The Grav-i-Flo Corporation, Sturgis, Mich.

[21] Appl. No.: 902,143

[22] Filed: Aug. 29, 1986

[51] Int. Cl.[4] ..... B24B 31/104

[52] U.S. Cl. ..... 51/7; 51/19; 51/263

[58] Field of Search ..... 51/7, 17, 19, 317, 322, 51/292, 263, 424, 425

[56] References Cited

U.S. PATENT DOCUMENTS

| | | | |
|---|---|---|---|
| 2,899,777 | 8/1959 | Davidson | 51/322 |
| 3,523,834 | 8/1970 | Hewins | 51/7 |
| 3,570,183 | 3/1971 | Ferrara | 51/7 |
| 4,173,851 | 11/1979 | Higashi | 51/7 |
| 4,240,229 | 12/1980 | Ohno | 51/19 |

FOREIGN PATENT DOCUMENTS

| | | | |
|---|---|---|---|
| 0523325 | 3/1956 | Canada | 51/19 |
| 0001153 | 1/1984 | Japan | 51/7 |
| 0019669 | 2/1984 | Japan | 51/317 |
| 0849340 | 9/1960 | United Kingdom | 51/7 |

*Primary Examiner*—Frederick R. Schmidt
*Assistant Examiner*—Robert A. Rose
*Attorney, Agent, or Firm*—Barnes, Kisselle, Raisch, Choate, Whittemore & Hulbert

[57] ABSTRACT

A finishing method and apparatus wherein a tub containing loose abrasive material is rotated at high speeds about a vertical axis to cause finishing media to form a layer of media along the side wall of the tube. One or more workpieces to be finished are supported in the media and are rotated about a vertical axis coincident or parallel to the axis of the tub such that a rapid cutting and finishing action is provided by the relative movement of the tub and the workpieces. The method and apparatus further comprises removing compound continuously from the lower part of the tub and cooling the material and returning it to the tub.

6 Claims, 3 Drawing Figures

FINISHING METHOD AND APPARATUS

This invention relates to finishing workpieces.

BACKGROUND AND SUMMARY OF THE INVENTION

In making various parts, it is necessary to deburr and polish the parts for final finishing such as plating and the like.

In one type of finishing machine that has been used, a vertical tub was positioned in a stationary support and parts were mounted on a fixture that was rotated about a vertical axis in damp powdered abrasive material in the tub.

In another type of machine, a large round drum was positioned horizontally and driven at high speed. The parts were conveyed into the drum by a fixtures on a conveyor. As the parts entered the drum, cams on the conveyor structure moved the workpieces into the abrasive media in the drum.

In another type of machine, the parts were mounted on fixtures, each fixture holding one piece which was slowly revolved in the abrasive media of a rotating drum.

In U.S. Pat. No. 2,899,777, a rotating head supports counter rotating vertical spindles on which the parts were mounted so that they were spun through the loose abrasive compound in a stationary tub.

In a further type of finishing apparatus, the parts are supported on a work carrier and positioned such that as a drum containing the abrasive media is rotated, the parts are subjected to the abrasive action of the compound. The carrier is provided with an indexing mechanism for moving the part to orient it with respect to the drum.

In connection with machines that have been used where the drum is rotated at high speed causing the abrasive media to collect about the side wall of the drum, it has been common to utilize a rack positioned so that it will periodically loosen and mix the media. Such an arrangement does not furnish completely effective mixing of the compound.

Among the objectives of the present invention are to provide a method and apparatus which will result in a rapid cutting and finishing action, wherein the abrasive media or compound is mixed thoroughly and will not become compacted and which can be readily adapted to different shapes and sizes of parts and different materials of parts.

In accordance with the invention, a finishing method and apparatus wherein a tub containing loose abrasive material is rotated at high speeds about a vertical axis to cause finishing media to form a layer of media along the side wall of the tube. One or more workpieces to be finished are supported in the media and are rotated about a vertical axis coincident or parallel to the axis of the tub such that a rapid cutting and finishing action is provided by the relative movement of the tub and the workpieces. The method and apparatus further comprises removing compound continuously from the lower part of the tub and cooling the material and returning it to the tub.

DESCRIPTION

Figure 1:
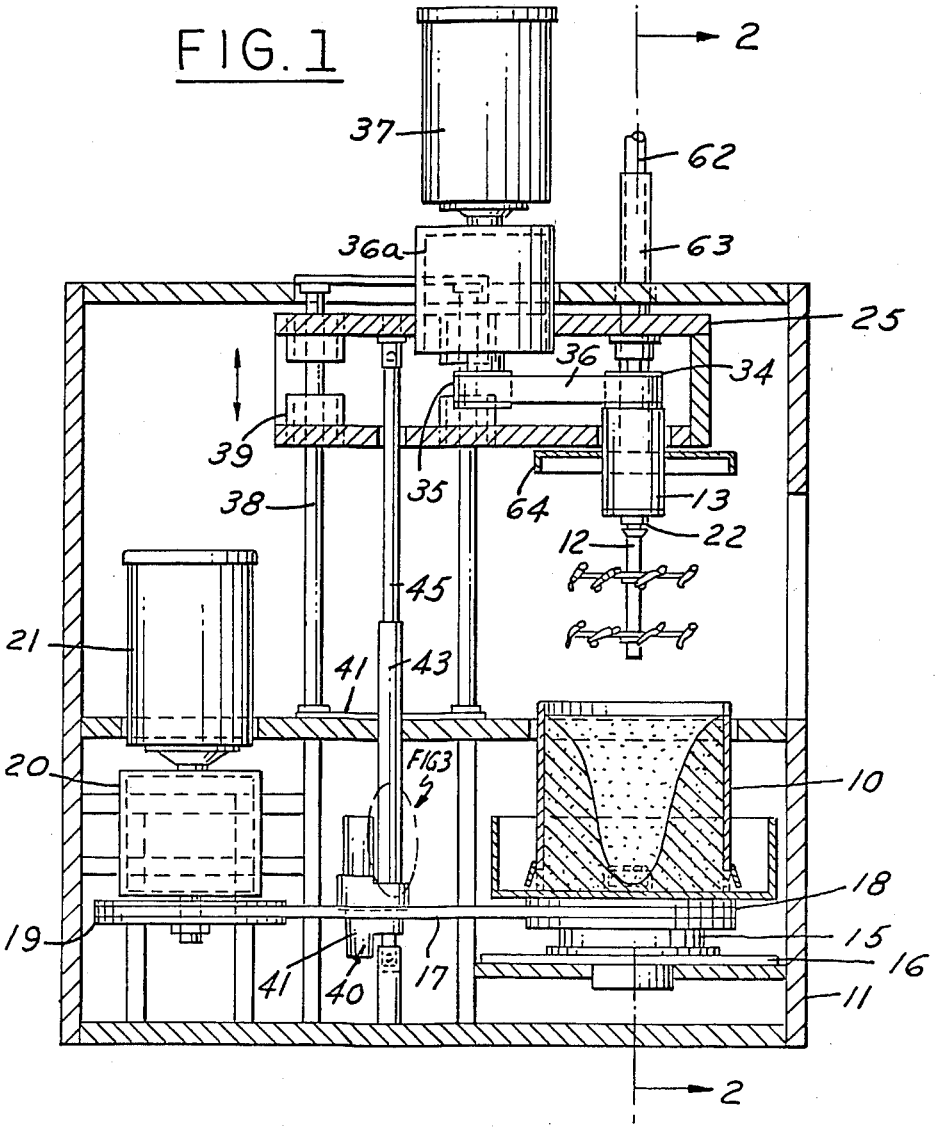
FIG. 1 is a front elevational view of an apparatus embodying the invention.
Figure 2:
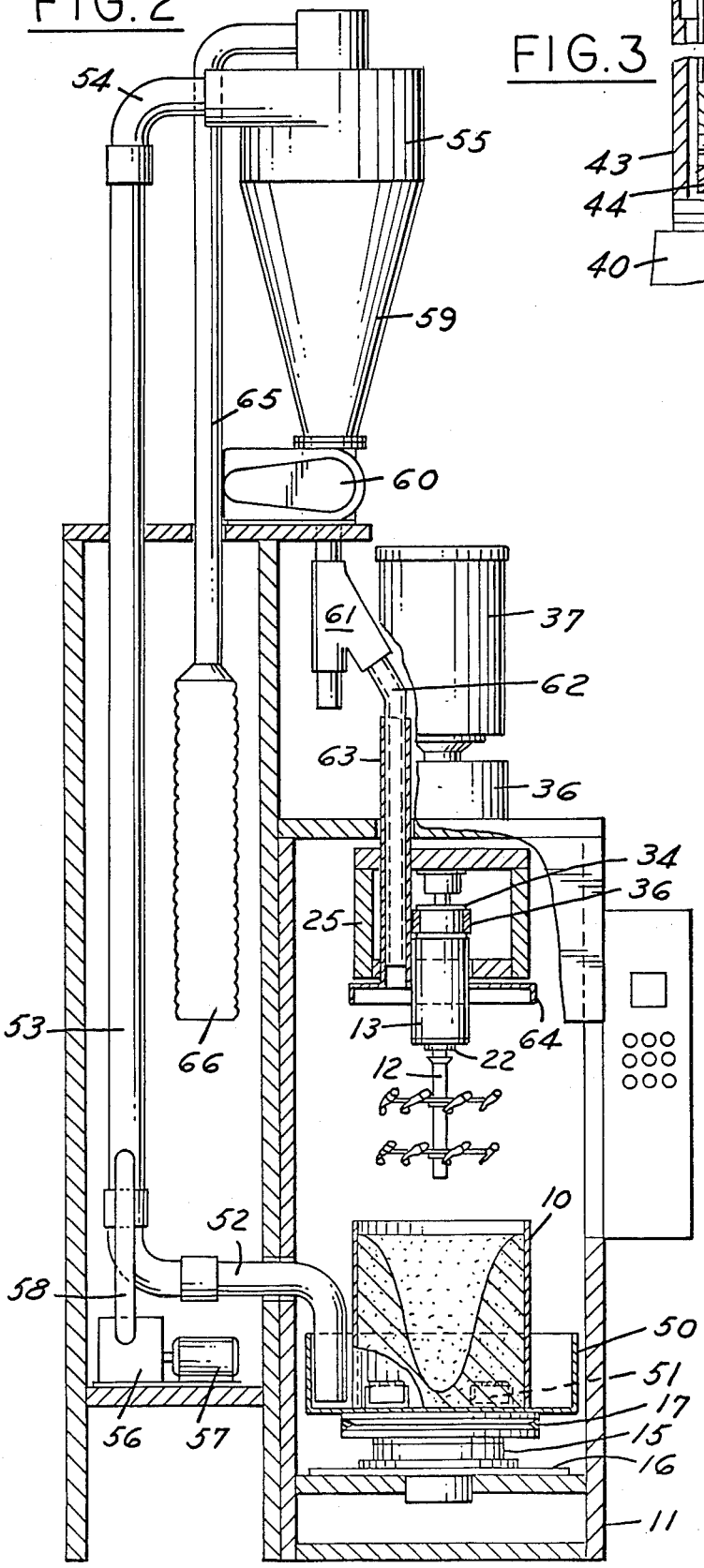
FIG. 2 is a side elevational view of the apparatus.
Figure 3:
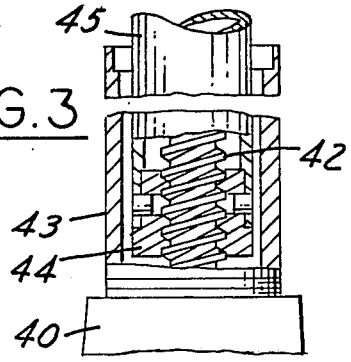
FIG. 3 is a fragmentary part sectional view on an enlarged scale taken along the line 3—3 in FIG. 1.

Referring to FIGS. 1 and 2, in accordance with the invention, a drum or tub 10 is provided on a frame 11 for rotation about the vertical axis of the tub 10 at a high speed such that a finishing medium collects by centrifugal action the side wall of the tub 10. A shaft 12 on a spindle 13 is provided on the frame 11 and is rotated about a vertical axis preferably about the center of the tub 10, and supports one or more workpieces or parts W for rotation about the axis of the spindle.

As the parts are positioned in the rotating media, a rapid cutting and finishing action is achieved and the movement of the parts relative to the media effectively cuts and finishes the surface of the parts without any need for any auxiliary mechanism to loosen and mix the media.

More specifically, tub 10 is mounted on a rotatable turntable 15 which, in turn, is mounted on a turntable mounting plate 16 on the frame 11. The turntable 15 is driven by belts trained over a pulley 18 on the turntable and a tub drive pulley 19 on the output shaft of a tub drive gear reducer 20 which, in turn, is connected to a tub drive motor 21, which is reversible.

Shaft 12 is removably mounted on the spindle 13 by a collet 22. Spindle 13 is rotatably mounted on a lift carriage 25 and driven by a pulley 34 and pulley 35 having a belt 36 trained over the pulleys. Pulley 35 is mounted on the output shaft of a spindle drive gear reducer *36a* which, in turn, is connected to a spindle drive motor 37 that is also reversible.

The lift carriage 25 is mounted for vertical movement on spaced vertical shafts 38 which are mounted on the frame 11 and extend through carriage guide bearings 39 on the carriage 25. A motor driven carriage lift assembly 40 is connected to the bottom of main frame and underside of lift carriage. Lift assembly comprises a motor housing 41 that is connected to the frame 11 by a clevis and rotates a screw 42 within a fixed vertical tube by a clevis that translates a nut 44 on a tube 45 connected to the carriage 25 by a clevis. Operation of the electric motor and gearing in the motor housing 41 rotates the screw 42 to raise and lower the carriage.

By this arrangement, workpieces are mounted on a shaft 12 and the shaft is inserted in the spindle 13. The tub 10 is rotated at high speed to cause the abrasive material to accumulate along the side wall of the tub due to centrifugal force. The carriage 25 is then lowered bringing the workpieces into position while the shaft supporting the workpieces is rotated to cause the media to provide a rapid cutting and finishing action without any need for any auxiliary mechanism to loosen or mix the media.

Further, in accordance with the invention, the apparatus includes a cooling system wherein part of the media or compound is collected through adjustable gated doors to control and allow for variation in the flow of the media to provide more or less cooling. In the lower part of the tub into an open top trough and an air evacuation system moves the compound to a separating apparatus such as a cyclone system where it is cooled and returned at a constant rate to the drum through piping. If required, an auxiliary refrigerant cooling is provided.

More specifically, an annular trough 50 is provided about the tub 10 and rotates therewith. Small adjustable gates or doors 51 in the side wall of the tub 10 permit a portion of the medium to move radially outwardly into the trough. The media is drawn upwardly by vacuum through a pipe 51 that has its lower end extending vertically into the trough and passes upwardly through a vertical portion 53 of the pipe and elbow 54 to the upper end of the cyclone separator where the medium separates from the air and falls downwardly into a media hopper 59 to a diverter valve 61 and, in turn, a fixed flow tube 62 extending into a sliding flow tube 63 which is fixed to splash cover 64. In this fashion, the media is cooled externally through passage by contact with the ambient air and returned to the tub when the spindle is lowered into position over the tub.

A vacuum is provided by a blower 56 driven by a blower motor 57 and connected with a pipe 58 to the vertical pipe 53. The air from the top of the cyclone separator extends to the atmosphere through a pipe 65 and airbag 66.

The utilization of the present apparatus permits also robotics to be utilized for loading and unloading the fixture which supports one or more parts. In addition, robotics may be utilized to index or change the position of the parts while the machine is operating as may be required in terms of complex parts to change the orientation of the parts relative to the apparatus.

In a typical example, the drum may comprise a tub 20 inches in diameter which is rotated at speeds up to 200 rpm. Spindle speeds may vary from approximately 20 rpm, when only one large workpiece is being finished, to speeds up to 600 rpm when a multiple number of workpieces are mounted on spindle shaft. Preferably the spindle speed in two times the speed of the drum. The spindle supports a 16 inch diameter fixture. In the case of large parts, the spindle axis is moved off center to allow for finishing of large workpieces.

It can thus be seen that there has been provided a method and apparatus which will operate in a very dense media such as provided by a rotating tub without the need for separate mixing of the media to prevent caking or compacting.

The apparatus is small in physical size, requiring less tooling, one fixture being needed to operate and the other being unloaded and loaded. By constantly removing cooling and returning the media externally of the machine, it is not necessary to provide any cooling to the machine itself.

We claim:

1. A finishing apparatus comprising a tub for containing loose abrasive material, mean for rotating the tub at high speeds to cause the material to accumulate along the wall of the tub, means supporting one or more workpieces to be finished within the material, means for rotating the workpiece about a vertical axis such that a rapid cutting and finishing action is provided by the relative movement of the tub and the workpieces, means for removing a portion of the abrasive material from the tube and moving said abrasive material exteriorly of the tub to cool the material and thereafter return the material to the tub, said means for removing a portion of the abrasive material comprising means defining a trough about the lower edge of the tub, means on the tub for permitting a portion of the material to pass into said trough, and pipe means for withdrawing the material, cooling the same exteriorly of the tub, and returning the material to the upper end of the tub, said pipe means including means for providing a vacuum for drawing said abrasive material through said pipe means, said pipe means including a cyclone separator for separating the material from air, an air lock, and a valve for delivering said abrasive material to the open end of the tub, a first pipe connected to said valve, a sliding flow tube, a cover attached to said sliding flow tube and movable with said spindle such that when the spindle is moved into position adjacent the tub, the material is guided by said flow tube and sliding flow tube into the tub.

2. The finishing apparatus set forth in claim 1 wherein said cover includes a peripheral flange surrounding the upper end of the tub when the spindle is in position in the tub.

3. The finishing apparatus set forth in claim 1 including filter means associated with said cyclone separator for filtering abrasive material out of the air.

4. A finishing apparatus comprising a tub for containing loose abrasive material, means for rotating the tub, means for supporting one or more workpieces to be finished within the material, means for removing a portion of the abrasive material from the tub and moving said abrasive material exteriorly of the tub to cool the material and thereafter return the material to the tub, said means for removing a portion of the abrasive material comprising means defining a trough about the lower edge of the tub, means on the tub for permitting a portion of the material to pass into said trough, and pipe means for withdrawing the material, cooling the same exteriorly of the tub, and returning the material to the upper end of the tub, said pipe means including means defining a vacuum for drawing said abrasive material through said pipe means, said pipe means including a cyclone separator for separating the material from air, an air lock, and a valve for delivering said abrasive material to the open end of the tub, a first pipe connected to said valve, a sliding flow tube, a cover attached to said sliding flow tube and movable with said spindle such that when the spindle is moved into position adjacent the tub, the material is guided by said flow tube and sliding flow tube into the tub.

5. The finishing apparatus set forth in claim 4 wherein said cover includes a peripheral flange surrounding the upper end of the tub when the spindle is in position in the tub.

6. The finishing apparatus set forth in claim 4 including filter means associated with said cyclone separator for filtering abrasive material out of the air.

* * * * *